US005810403A

United States Patent [19]

Prada

[11] Patent Number: 5,810,403

[45] Date of Patent: Sep. 22, 1998

[54] SNAP LATCH ASSEMBLY FOR A DISHWASHER

[75] Inventor: Luis Esteban Prada, Louisville, Ky.

[73] Assignee: General Electric Company, Louisville, Ky.

[21] Appl. No.: 717,527

[22] Filed: Sep. 17, 1996

[51] Int. Cl.[6] ..... E05C 19/10

[52] U.S. Cl. ..... 292/128; 292/228; 292/DIG. 69

[58] Field of Search ..... 292/DIG. 69, 128, 292/228, DIG. 30; 200/61.64, 61.62, 61.67

[56] References Cited

U.S. PATENT DOCUMENTS

| | | | |
|---|---|---|---|
| 3,099,471 | 7/1963 | Scott et al. . | |
| 3,328,062 | 6/1967 | Geiger et al. . | |
| 3,415,961 | 12/1968 | Barnard . | |
| 3,841,675 | 10/1974 | Mercer | 292/DIG. 69 X |
| 3,841,677 | 10/1974 | Guth | 292/DIG. 69 X |
| 4,105,229 | 8/1978 | Kaldenberg . | |
| 4,764,648 | 8/1988 | Resh . | |
| 4,776,620 | 10/1988 | Marks et al. . | |
| 5,174,618 | 12/1992 | Kropf . | |

*Primary Examiner*—Rodney M. Lindsey
*Attorney, Agent, or Firm*—H. Neil Houser

[57] ABSTRACT

A latch assembly for a dishwasher which enables one step initiation of dishwasher operations is described. The latch assembly also provides that the dishwasher does not operate when the dishwasher door is, or can be, opened. In one embodiment, the latch assembly is configured for use in connection with a dishwasher including a door, a tub, and a keeper secured to the tub. The keeper includes a catch and a lock release projection. The latch assembly includes a handle and at least one switch. The handle includes a latch and has a closed position and an open position. The latch is configured to engage the keeper catch when the door is closed and to disengage from the keeper catch when the handle is in the open position. The latch assembly further includes a switch actuator configured to actuate the switch so that the switch is in a conducting state when the door is substantially closed and so that the switch is in a non-conducting state when the handle is substantially in the open position. The switch is electrically connected to other components of the dishwasher so that dishwasher operations are prevented when the switch is in the non-conducting state and so that dishwasher operations are enabled when the switch is in a conducting state.

16 Claims, 3 Drawing Sheets

Fig. 1
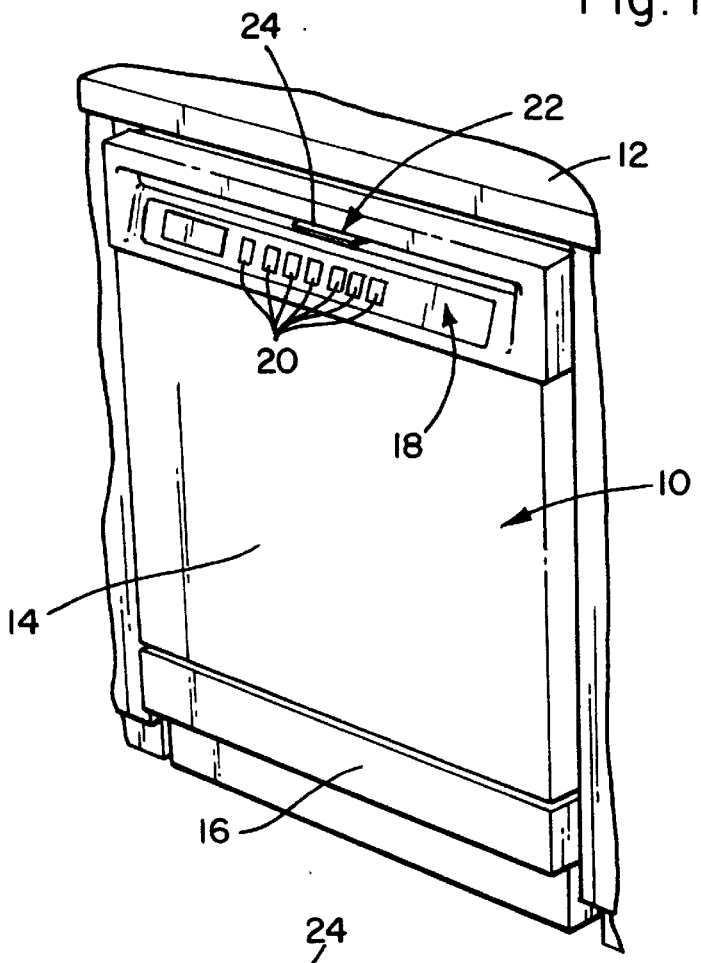
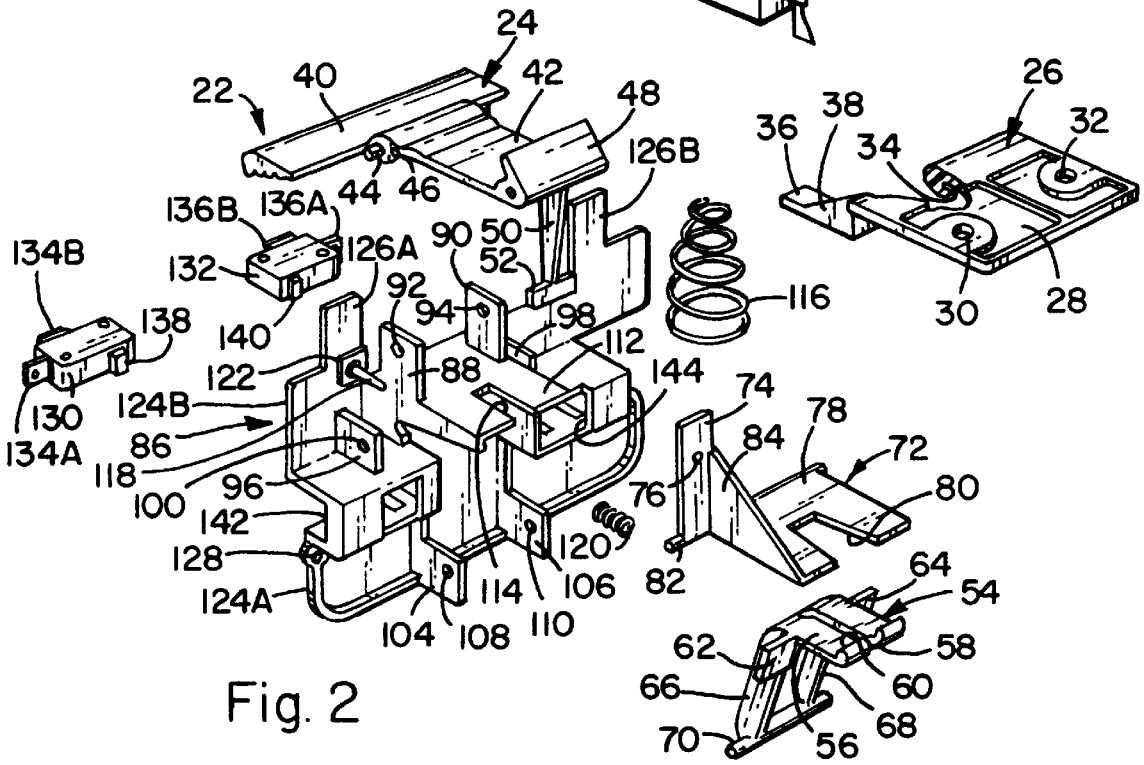
Fig. 2

SNAP LATCH ASSEMBLY FOR A DISHWASHER

FIELD OF THE INVENTION

This invention relates generally to dishwashers and, more particularly, to a snap latch for a dishwasher door.

BACKGROUND OF THE INVENTION

Known dishwashers include a hinged door and a latch mechanism which prevents operation of the dishwasher unless the door is latched in a closed position. In one known configuration, the door latch mechanism includes an operator actuated lever including a hook configured to be hooked to a keeper secured to the dishwasher tub. A finger extends from the keeper and is configured to extend through an opening in an inner wall of the dishwasher door to a lever stop which prevents movement of the lever unless the stop is depressed by the keeper finger. The stop is spring biased to be in position to prevent movement of the lever from the open to the closed position.

A lever-controlled switch is mounted with the dishwasher door, and when the lever is in a closed position, the switch is in a conducting state. When the lever is in an open position, the switch is in a non-conducting state. The switch is electrically connected to other components of the dishwasher so that when the switch is in the conducting state, the dishwasher may operate and when the switch is in a non-conducting state, dishwasher operation is interrupted or prevented. When the operator actuated lever is in the open position, the dishwasher door can be freely opened and closed. It is important that the dishwasher not operate when the dishwasher door is open.

With the above described latch mechanism, two motions are required by the operator in order to initiate dishwasher operations. First, the door must be closed to a position that allows the keeper finger to depress the lever stop. Second, the operator must push the lever from the open position to the closed position, e.g., from left to right over an overcenter position, to latch the door to the tub.

Although the above described latch mechanism is effective in controlling dishwasher operations, the mechanism requires a user to perform two (2) motions to initiate dishwasher operations. It would be desirable to further simplify, or reduce, the operator actions required to initiate dishwasher operations. Of course, simplifying the operator required actions to initiate dishwasher operations should not result in undesired operation of the dishwasher. For example, it is important that the dishwasher not operate when the dishwasher door is, or can be, opened.

SUMMARY OF THE INVENTION

These and other objects may be attained in a latch assembly for a dishwasher which enables one step initiation of dishwasher operations and also provides that the dishwasher does not operate when the dishwasher door is, or can be, opened. In one embodiment, the latch assembly is configured for use in connection with a dishwasher including a door, a tub, and a keeper secured to the tub. The keeper includes a catch and a lock release projection. The latch assembly includes a handle and at least one switch. The handle includes a latch and has a closed position and an open position. The latch is configured to snap into engagement with the keeper catch when the door is closed and to disengage from the keeper catch when the handle is in the open position.

The latch assembly further includes a switch actuator configured to actuate the switch so that the switch is in a conducting state when the door is substantially closed and so that the switch is in a non-conducting state when the handle is substantially in the open position. The switch is electrically connected to other components of the dishwasher so that dishwasher operations are prevented when the switch is in the non-conducting state and so that dishwasher operations are enabled when the switch is in a conducting state.

The above described latch assembly is effective in controlling dishwasher operations and requires an operator to perform only one (1) motion to initiate dishwasher operations. Specifically, by simply closing the dishwasher door, the latch snaps into engagement with the keeper and the switch transitions to the conducting state. Dishwasher operations can then be initiated, e.g., by selecting the desired control position of the dishwasher controls. Further, such simplification in the motion required to initiate dishwasher operations is achieved without adverse consequences. For example, with the above described latch assembly, the switch quickly transitions to the non-conducting condition when the handle is moved from the closed position to the open position. Such quick transition provides that dishwashing operations are substantially interrupted before the dishwasher door can be opened by an operator.

BRIEF DESCRIPTION OF THE DRAWINGS

FIG. 1 is a perspective view of an under-the-counter type dishwasher with portions of the counter cut away.

FIG. 2 is an exploded view of a latch assembly in accordance with one embodiment of the present invention.

DETAILED DESCRIPTION OF THE DRAWINGS

Figure 4:
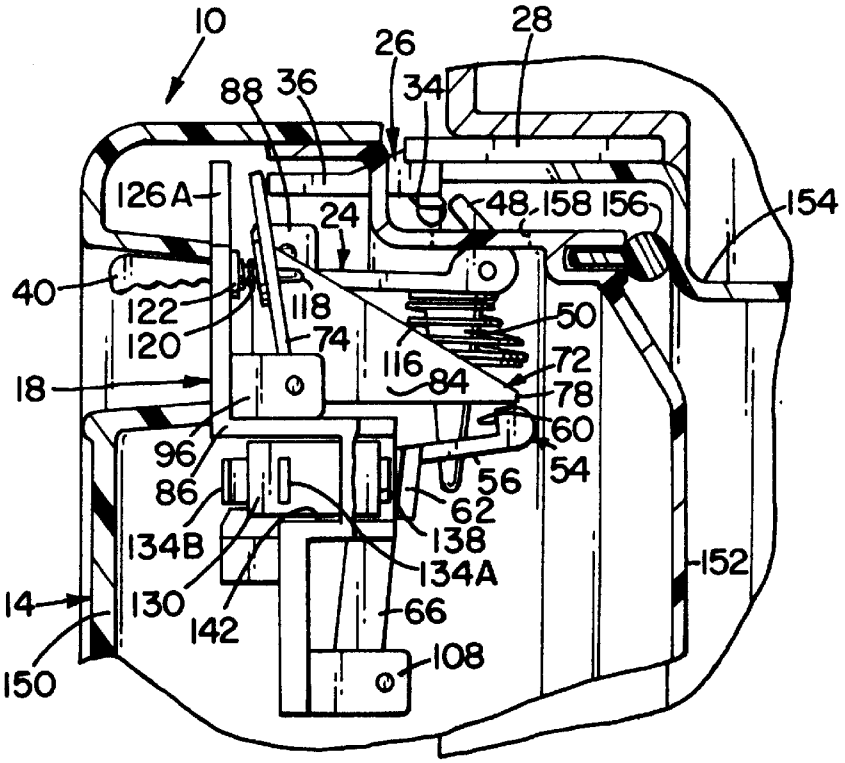
FIG. 4 is a partial cross section view of the latch assembly shown in FIG. 3 with the handle in the open position and with the latch moving away from the keeper catch.

FIG. 1 is a perspective view of an under-the-counter type dishwasher 10 with portions of a counter 12 cut away. Dishwasher 10 includes a hinged door 14 and a base 16. A control panel 18 including controls 20 is secured to door 14. Also, dishwasher 10 includes a latch assembly 22 including a handle 24 in accordance with one embodiment of the present invention. In general, and in accordance with the one embodiment, to open door 14, an operator pushes up on handle 24 and dishwasher 10 operation is interrupted, or is prevented. Door 14 can then be freely opened for loading or unloading dishes. To initiate operations, an operator simply closes door 14, and handle 24 snaps to a closed position. Dishwasher 10 is then ready to begin operating.

The one-step motion for initiating dishwasher operations with latch assembly 22 as described above is simple as compared to the known two-step motions. In addition, latch assembly 22 is not believed to increase the cost of the dishwasher and does not adversely affect dishwasher operations. For example, with assembly 22, door 14 cannot be opened while dishwasher 10 is operating.

Dishwasher 10 may, for example, be model number GSD650, commercially available from General Electric Company, Appliance Park, Louisville, Ky. 40225, modified to include latch assembly 22, which is described below in more detail. Latch assembly 22, however, can be used in connection with many other dishwashers and is not limited to use with any one particular dishwasher.

FIG. 2 is an exploded view of latch assembly 22. Specifically, assembly 22 includes a keeper 26, shown with a section cut away, for being secured to a dishwasher tub (not shown in FIG. 2). Keeper 26 includes an engagement plate 28 having openings 30 and 32 therein. Threaded bolts (not shown) can be inserted through openings 30 and 32 and into threaded engagement with aligned openings (not shown) in the dishwasher tub. Keeper 26 also includes a catch 34 and a lock release projection 36. A stiffener rib 38 extends between engagement plate 28 and lock release projection 36.

Latch assembly 22 includes handle 24 having an elongate grip 40. Handle 24 also includes a latch plate 42 having a hinge pin 44 secured in a hinge pin recess 46 and a latch 48. A handle lever 50 extends from latch plate 42 and includes a switch actuator lock catch pad 52.

Assembly 22 further includes a switch actuator 54 including a lock catch plate 56 having a handle lever clearance slot 58 and a lock catch 60. Switch actuating pads 62 and 64 extend from lock catch plate 56. Switch actuator 54 also includes hinge arms 66 and 68 extending from lock catch plate 56, and a hinge pin 70 is secured to hinge arms 66 and 68.

Assembly 22 also includes a lock lever 72 including a lock trigger 74 having a pin opening 76 therein. Lever 72 also includes a lever plate 78 having a handle lever clearance slot 80. A hinge pin 82 extends from plate 78. A stiffener rib 84 extends from lock trigger 74 to lever plate 78.

Handle 24, switch actuator 54 and lock lever 72 are secured to a bracket 86. Specifically, bracket 86 includes handle pivot arms 88 and 90 having openings 92 and 94 therein for mating with handle hinge pin 44. Bracket 86 also includes lock lever pivot arms 96 and 98 having openings 100 and 102 (opening 102 is not visible in FIG. 2) therein for mating with lock lever hinge pin 82, and switch actuator pivot arms 104 and 106 having openings 108 and 110 for mating with switch actuator hinge pin 70. Bracket 86 also includes a spring platform 112 having a handle lever clearance slot 114. When assembled, handle lever 50 extends through a handle lever spring 116, handle lever clearance slot 114 in platform 112, slot 80 in lock lever 72, and through clearance slot 58 in switch actuator 54. Handle lever spring 116 rests on spring platform 112 of bracket 86 and is biased so that latch 48 is biased away from platform 112. The force required to engage latch 48 to keeper 26 is provided by spring 116. Spring 116 also provides the force to move switch actuator 54. Bracket 86 further includes a lock spring locator 118, and a lock spring 120 is positioned over locator 118 and extends between a spring contact surface 122 of bracket 86 and lock trigger 74 of lock lever 72.

Bracket 86 further includes mounting surfaces 124A and 124B and extension tabs 126A and 126B for secure positioning of assembly 22 in dishwasher door 14 (FIG. 1), as described hereinafter in more detail. Openings 128 (only one opening 128 is visible in FIG. 2) in bracket 86 are sized so that mounting screws can be inserted therethrough to engage bracket 86 to door 14.

Assembly 22 further includes push button type switches 130 and 132. Switches 130 and 132 includes blade terminals 134A–B and 136A–B and outward biased buttons 138 and 140, respectively. With respect to switch 130, when button 138 is depressed, switch 130 is in a conducting condition. When button 138 is not depressed, switch 138 is in a non-conducting condition. Switch 132 operates in an identical manner in connection with button 140. Switches 130 and 132 are mounted within respective switch mounts 142 and 144 in bracket 86, and are engagable by switch pads 62 and 64 of switch actuator 54.

Keeper 26, handle 24, lock lever 72, and switch actuator 54 are formed by injection molding using a plastic such as acetal. Bracket 86 can be formed by injection molding using plastic such as glass filled polyester, e.g., VALOX™ plastic (VALOX is a trademark of General Electric Company). Both handle spring 116 and lock lever spring 120 are compression type springs well known in the art, and switches 130 and 132 may, for example, be model number V3-3014-D9 type switches commercially available from Micro Switch (a division of Honeywell, Inc.), Freeport, Ill., 61032. It is contemplated, of course, that alternative materials and switches can be used in latch assembly 22.

Figure 3:
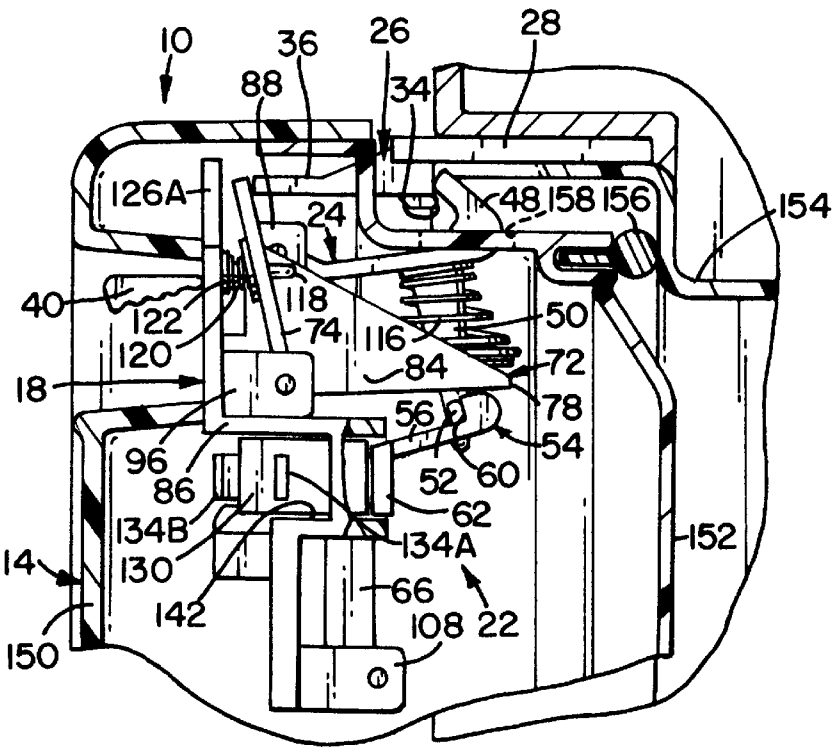
FIG. 3 is a partial cross section view, with parts cut away, of the latch assembly shown in FIG. 1 mounted to a dishwasher and in a closed position.

FIG. 3 is a partial cross section view, with parts cut away, of latch assembly 22 mounted to dishwasher door 14 and in a closed position. As shown in FIG. 3, dishwasher door 14 includes an outer wall 150 and an inner wall 152. Dishwasher 10 also includes a tub 154. A gasket 156 engaged to inner door wall 152 forms a seal between door 14 and tub 154 when door 14 is closed. Keeper 26 is secured to tub 154 so that catch 34 extends toward latch 48. Bracket 86 is secured to outer door wall 150 by threaded bolts (not shown) that extend through outer door wall 150 and through openings 128 in bracket 86.

Switches 130 and 132 typically are electrically connected in series between a power supply and dishwasher components so that when both switches are in the conducting condition, the dishwasher may operate. If either switch 130 or 132 is in the non-conducting condition, however, the dishwasher will not operate.

When in the closed position as shown in FIG. 3, handle latch 48 extends through an opening 158 in inner door wall 152 and into engagement with catch 34 of keeper 26. Also, keeper lock release projection 36 acts against lock trigger 74 which compresses spring 120. Pads 52 of handle lever 50 are engaged to lock catch 60 of switch actuator 54 and biases switch actuator 54 so that switch actuating pads 62 and 64 are in contact with, and depress, buttons 138 and 140 of switches 130 and 132. Therefore, switches 130 and 132 are in the conducting condition and dishwasher 10 may operate.

FIG. 4 is a partial cross section view of latch assembly 22 shown in FIG. 3 with handle 24 in the open position and with latch 48 moving away from catch 34 of keeper 26. More specifically, FIG. 4 is a "snap shot" of the momentary relative positioning of the components of latch assembly 22 immediately after an operator pushes upward on grip 40 to open door 14. As shown in FIG. 4, spring 116 is compressed which causes handle lever 48 to move away from keeper catch 34 and switch actuator 54. As a result, switch actuating pads 62 and 64 are pushed outward due to the force exerted by spring 120 through lock lever 72 and the biasing of switch buttons 138 and 140, and switches 130 and 132 transition from the closed, conducting condition to the open, non-conducting condition. The dishwasher operations therefore are interrupted, or prevented. Importantly, such operations are interrupted before door 14 is opened by an operator.

Figure 5:
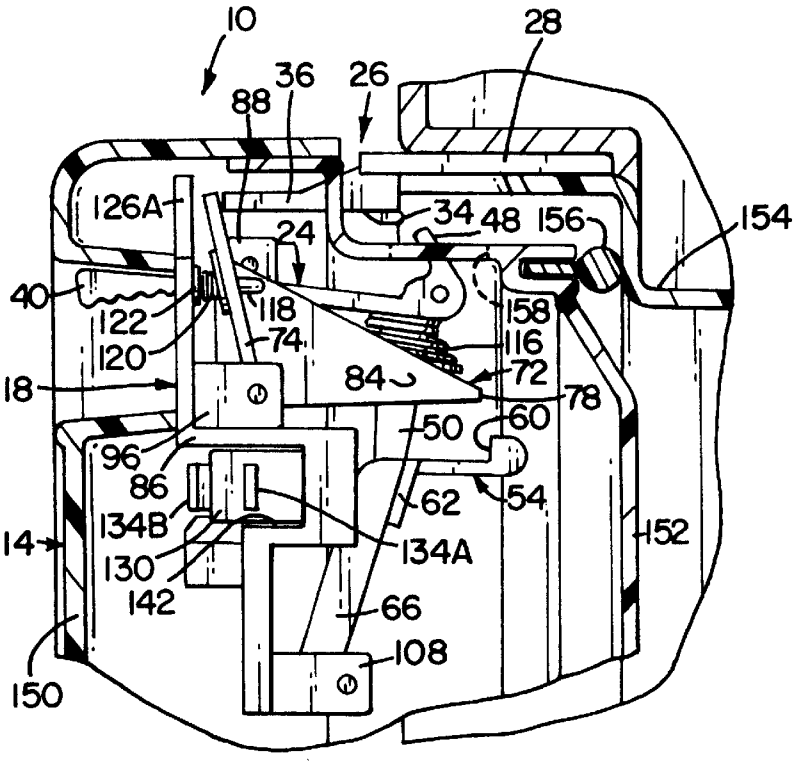
FIG. 5 is a partial cross section view of the latch assembly shown in FIG. 3 with the handle in the open position and the latch disengaged from the keeper.

FIG. 5 is a partial cross section view of latch assembly 22 once spring 116 is fully compressed after handle 24 has been moved to the open position. More specifically, FIG. 5 illustrates the positioning of the components of latch assembly 22 once handle 24 has been moved to an open position but before the operator begins to open door 14. As shown in FIG. 5, spring 116 is fully compressed and latch 48 is fully disengaged from catch 34. Finger projection 36 continues to act against trigger 74 and prevents trigger 74 from rotating.

Figure 6:
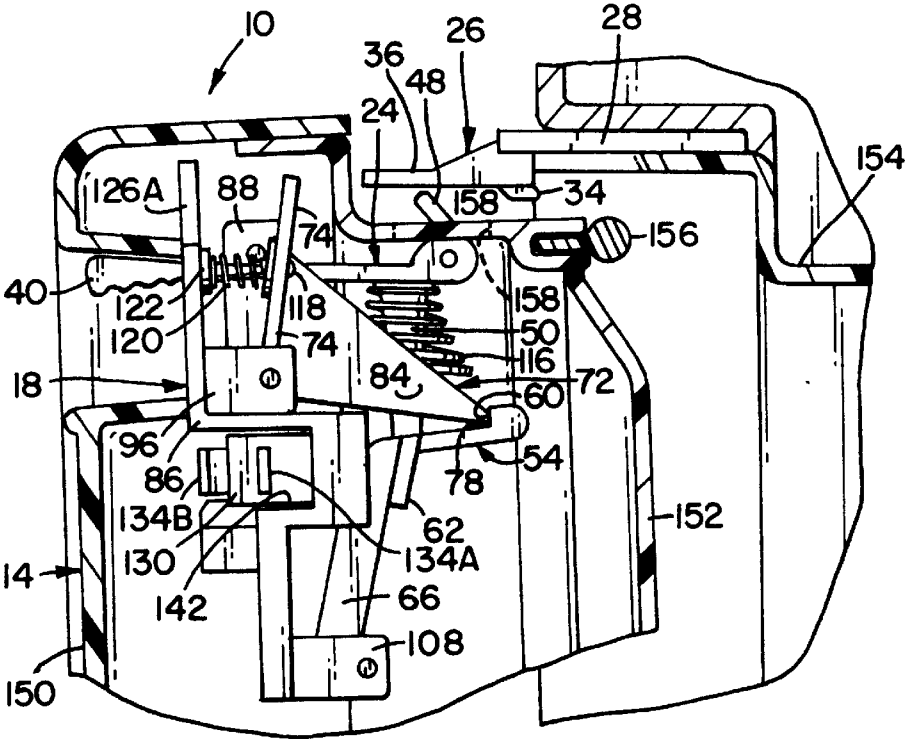
FIG. 6 is a partial cross section view of the latch assembly shown in FIG. 3 with the handle in the open position and with the door being opened.

FIG. 6 is a partial cross section view of latch assembly 22 once the operator begins to open door 14. More specifically, FIG. 6 illustrates the final positioning of the components of latch assembly 22 once handle 24 has been moved to the open position and once door 14 is being opened. As shown in FIG. 6, finger projection 36 has moved out of contact with trigger 74, thus allowing lock lever 72 to rotate so that lock catch 60 engages lever plate 78. Such an arrangement prevents switch actuator 54 from rotating while door 14 is open, thus preventing switch pads 62 and 64 from contacting and depressing buttons 138 and 140 of switches 130 and 132. Also, spring 116 expands, thus driving latch 48 upward. With latch 48 in this position, latch 48 is positioned to snap into engagement with catch 34 once the operator closes door 14.

Latch assembly 22 is believed to be effective in controlling dishwasher operations, and simplifies the operator actions required to initiate dishwasher operations. In addition, providing such simple operator required action to initiate dishwasher operations is not believed to result in an increase in the cost of the dishwasher nor adversely affect dishwasher operation.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A latch assembly for a dishwasher including a door and a tub, said latch assembly comprising:

a keeper adapted to be secured to the tub, said keeper comprising a catch and a lock release projection;

a handle comprising an elongate grip, a latch plate having a latch at one end thereof, a hinge pin secured in a hinge pin recess in said latch plate, and a handle lever extending from said latch plate and including a switch actuator lock catch pad;

a switch actuator comprising a lock catch plate having a handle lever clearance slot and a lock catch, a switch actuating pad extending from said lock catch plate, said switch actuator further comprising hinge arms extending from said lock catch plate, and a hinge pin secured to said hinge arms;

a lock lever comprising a lock trigger having a pin opening therein, a lever plate having a handle lever clearance slot, and a hinge pin extending from said lever plate; and a bracket comprising handle pivot arms having openings therein mating with said handle hinge pin, lock lever pivot arms having openings therein mating with said lock lever hinge pin, and switch actuator pivot arms having openings therein mating with said switch actuator hinge pin, said bracket further comprising a spring platform having a handle lever clearance slot therein, and a lock spring locator;

a handle lever spring, said handle lever extending through said handle lever spring, said handle lever clearance slot in said lock lever, said handle lever clearance slot in said bracket spring platform, and through said handle lever clearance slot in said switch actuator, said handle lever spring resting on said spring platform of said bracket so that said latch of said handle is biased away from said platform; and a lock spring positioned over said lock spring locator of said bracket and extending from said bracket to said lock trigger of said lock lever.

2. A latch assembly in accordance with claim 1 wherein said bracket further comprises mounting surfaces and extension tabs for secure positioning of said bracket to the dishwasher door.

3. A latch assembly in accordance with claim 1 wherein said handle lever spring and said lock spring are compression springs.

4. A latch assembly in accordance with claim 1 further comprising at least one switch and said bracket further comprises a switch mount, said switch located within said switch mount.

5. A latch assembly in accordance with claim 4 wherein said switch is configured to be electrically connected in series between an energy source and a motor of the dishwasher, said switch further comprising an actuator button located to be engaged by said switch actuating pad of said switch actuator.

6. A latch assembly for a dishwasher including a door and a tub, a keeper secured to the tub and including a catch and a lock release projection, said latch assembly comprising:

a handle and at least one switch, said handle comprising a latch and having a closed position and an open position, said latch configured to engage the keeper catch when the door is closed and to disengage from the keeper catch when said handle is in the open position, said handle further comprising a hinge pin, said latch assembly further comprising a switch actuator comprising a hinge pin and configured to actuate said switch so that said switch is in a conducting state when the door is substantially closed and so that said switch in a non-conducting state when said handle is substantially in the open position, said latch assembly further comprising a bracket comprising handle pivot arms having openings therein mating with said handle hinge pin, and switch actuator pivot arms having openings therein mating with said switch actuator hinge pin.

7. A latch assembly in accordance with claim 6 wherein said handle further comprises an elongate grip, a latch plate having said latch secured to one end thereof, and a handle lever extending from said latch plate and including a switch actuator lock catch pad, and said switch actuator comprises a lock catch plate having a handle lever clearance slot and a lock catch, a switch actuating pad extending from said lock catch plate, said switch actuator further comprising hinge arms extending from said lock catch plate, said switch actuator hinge pin secured to said hinge arms.

8. A latch assembly in accordance with claim 7 further comprising:

a lock lever comprising a lock trigger having a pin opening therein, a lever plate having a handle lever clearance slot, and a hinge pin extending from said plate; and said bracket further comprises lock lever pivot arms having openings therein mating with said lock lever hinge pin, said bracket further comprising a spring platform having a handle lever clearance slot therein, and a lock spring locator.

9. A latch assembly in accordance with claim 8 further comprising:

a handle lever spring, said handle lever extending through said handle lever spring, said handle lever clearance slot in said lock lever, said handle lever clearance slot in said bracket spring platform, and through said handle lever clearance slot in said switch actuator, said handle lever spring resting on said spring platform of said bracket so that said latch of said handle is biased away from said platform; and a lock spring positioned over said lock spring locator of said bracket and extending from said bracket to said lock trigger of said lock lever.

10. A latch assembly in accordance with claim 9 wherein said bracket further comprises mounting surfaces and extension tabs for secure positioning of said bracket to the dishwasher door.

11. A latch assembly in accordance with claim 7 wherein said switch is configured to be electrically connected in series between an energy source and a motor of the dishwasher, said switch further comprising an actuator button located to be engaged by said switch actuating pad of said switch actuator.

12. A dishwasher comprising a door having a closed position and an open position, a tub, a removable keeper secured to the tub and including a catch comprising a projection and a lock release projection extending forwardly from the tub, and a latch assembly comprising a handle and at least one switch, said handle extending through said door and having a closed position and an open position, said handle comprising a latch configured to engage said keeper catch when said door is the closed position and to disengage from said keeper catch when said handle is in the open position, said latch assembly further comprising a switch actuator configured to actuate said switch so that said switch is in a conducting state when said door is substantially in the closed position and so that said switch in a non-conducting state when said handle is substantially in the open position.

13. A dishwasher in accordance with claim 12 wherein said handle further comprises an elongate grip, a latch plate having said latch secured to one end thereof, a hinge pin secured in a hinge pin recess, and a handle lever extending from said latch plate and including a switch actuator lock catch pad, and said switch actuator comprises a lock catch plate having a handle lever clearance slot and a lock catch, a switch actuating pad extending from said lock catch plate, said switch actuator further comprising hinge arms extending from said lock catch plate, and a hinge pin secured to said hinge arms.

14. A dishwasher in accordance with claim 13 wherein said latch assembly further comprises:

a lock lever comprising a lock trigger having a pin opening therein, a lever plate having a handle lever clearance slot, and a hinge pin extending from said plate; and a bracket comprising handle pivot arms having openings therein mating with said handle hinge pin, lock lever pivot arms having openings therein mating with said lock lever hinge pin, and switch actuator pivot arms having openings therein mating with said switch actuator hinge pin, said bracket further comprising a spring platform having a handle lever clearance slot therein, and a lock spring locator.

15. A dishwasher in accordance with claim 14 wherein said latch assembly further comprises:

a handle lever spring, said handle lever extending through said handle lever spring, said handle lever clearance slot in said lock lever, said handle lever clearance slot in said bracket spring platform, and through said handle lever clearance slot in said switch actuator, said handle lever spring resting on said spring platform of said bracket so that said latch of said handle is biased away from said platform; and a lock spring positioned over said lock spring locator of said bracket and extending from said bracket to said lock trigger of said lock lever.

16. A dishwasher in accordance with claim 15 wherein said bracket further comprises mounting surfaces and extension tabs.

* * * * *